US011008871B2

(12) United States Patent
Daehnert et al.

(10) Patent No.: US 11,008,871 B2
(45) Date of Patent: May 18, 2021

(54) TURBINE BLADE OF A TURBINE BLADE RING

(71) Applicant: Rolls-Royce Deutschland Ltd & Co KG, Blankenfelde-Mahlow (DE)

(72) Inventors: Jerrit Daehnert, Rangsdorf (DE); Josu Guridi, Berlin (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 496 days.

(21) Appl. No.: 16/180,882

(22) Filed: Nov. 5, 2018

(65) Prior Publication Data

US 2019/0153874 A1 May 23, 2019

(30) Foreign Application Priority Data

Nov. 8, 2017 (DE) ..... 10 2017 126 105.2

(51) Int. Cl.
*F01D 5/18* (2006.01)
*F01D 5/14* (2006.01)
*F01D 5/08* (2006.01)

(52) U.S. Cl.
CPC ..... *F01D 5/187* (2013.01); *F01D 5/081* (2013.01); *F01D 5/143* (2013.01); *F01D 5/145* (2013.01);

(Continued)

(58) Field of Classification Search
CPC . F01D 5/081; F01D 5/18; F01D 5/186; F01D 5/187; F01D 5/143; F01D 5/145
See application file for complete search history.

(56) References Cited

U.S. PATENT DOCUMENTS 8,864,444 B2 * 10/2014 Antunes ..... F01D 5/14 415/115
2006/0083613 A1 * 4/2006 Cunha ..... F01D 5/081 416/97 R (Continued)

FOREIGN PATENT DOCUMENTS

EP 1688587 A2 8/2006
WO WO2010103113 A1 9/2010
WO WO2017191071 A1 11/2017

OTHER PUBLICATIONS

German Search Report dated Sep. 25, 2018 from counterpart German App No. 102017126105.2.

(Continued)

*Primary Examiner* — Woody A Lee, Jr.
(74) *Attorney, Agent, or Firm* — Shuttleworth & Ingersoll, PLC; Timothy J. Klima

(57) ABSTRACT

A turbine blade of a turbine rotor blade ring, having a suction side, a pressure side and a cooling air duct through which a cooling medium is conveyable for cooling the turbine blade. It is provided that the cooling air duct has in at least one section a course such that its cross-sectional surface increases in the flow direction of the cooling medium up to a maximum in a first, widening partial section, its cross-sectional surface decreases in a second, narrowing partial section behind the maximum, and the cooling medium in the second, narrowing partial section is accelerated with a directional component in the direction of the suction side of the turbine blade. The invention furthermore relates to a method for conveying a cooling medium in a turbine blade of a turbine rotor blade ring.

19 Claims, 6 Drawing Sheets

Figure 1:
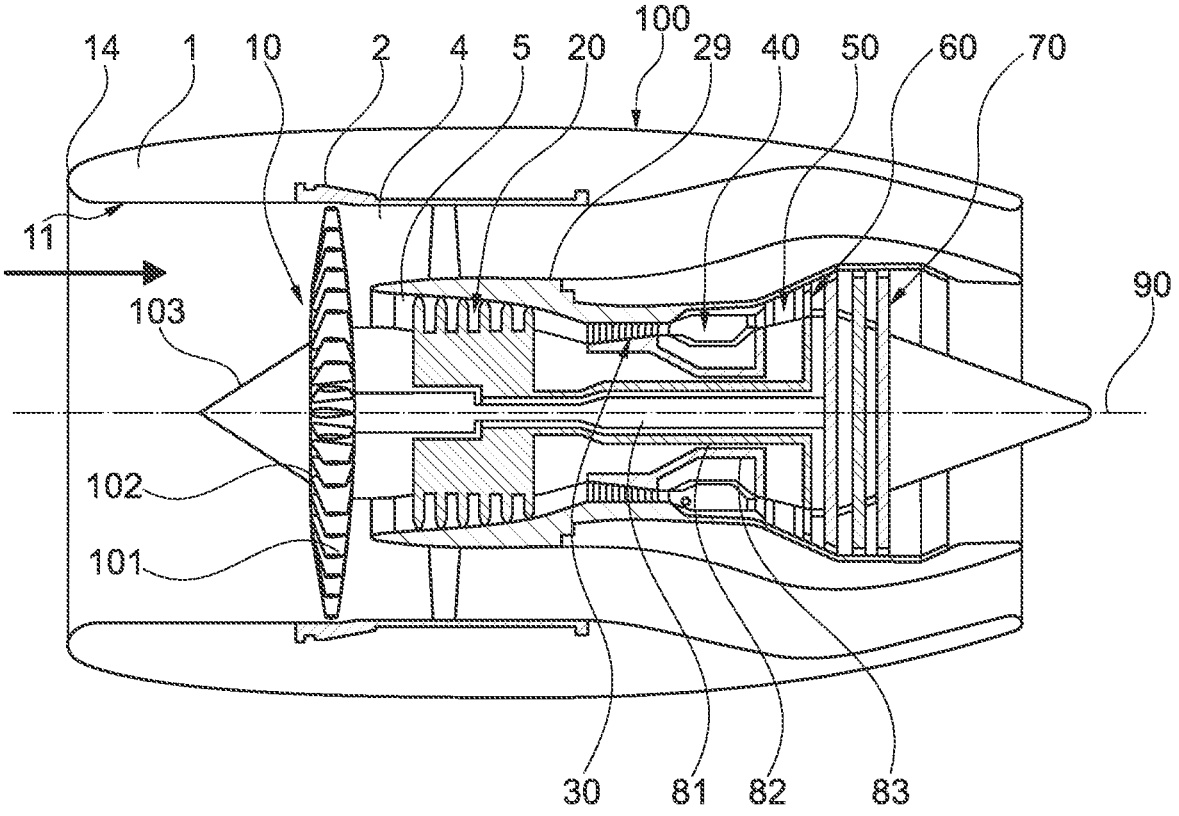

(52) U.S. Cl.
CPC ..... *F01D 5/18* (2013.01); *F01D 5/186* (2013.01); *F05D 2220/323* (2013.01); *F05D 2240/301* (2013.01); *F05D 2260/201* (2013.01); *F05D 2260/202* (2013.01); *F05D 2260/941* (2013.01)

(56) References Cited

U.S. PATENT DOCUMENTS

| | | | | |
|---|---|---|---|---|
| 2006/0153681 | A1* | 7/2006 | Lee | F01D 5/143 416/97 R |
| 2007/0020100 | A1* | 1/2007 | Beeck | F01D 5/187 416/193 A |
| 2010/0290920 | A1 | 11/2010 | Liang | |

OTHER PUBLICATIONS

European Search Report dated Mar. 25, 2019 for counterpart European Patent Application No. 18204562.5.

* cited by examiner

TURBINE BLADE OF A TURBINE BLADE RING

This application claims priority to German Patent Application DE102017126105.2 filed Nov. 8, 2017, the entirety of which is incorporated by reference herein.

This invention relates to a turbine blade of a turbine rotor blade ring in accordance with the present disclosure as well as to a method for conveying a cooling medium in a turbine blade of a turbine rotor blade ring.

Cooling the turbine blades of a gas turbine is well known. To cool the turbine blades, they have internal cooling air ducts that are subjected to air. Here, the Coriolis force acts on the cooling medium during operation of the gas turbine. Since a turbine blade has a sense of rotation in the direction of the suction side, the cooling medium is deflected by the Coriolis force in the direction of the pressure side. This leads to the cooling medium cooling different wall areas of the cooling air duct to a varying degree. This involves inhomogeneity in cooling, which reduces its effectivity and can induce thermal stresses in the material.

The object underlying the present invention is to provide a turbine blade and a method for conveying a cooling medium in a turbine blade that enable an improved cooling of the turbine blade.

It is a particular object of the present invention to provide solution to the above problems by a turbine blade having features as disclosed herein and a method having features as disclosed herein. Embodiments will become apparent from the present disclosure.

Accordingly, the invention provides in a first aspect of the invention that a cooling air duct of a turbine blade has in at least one section a course such that its cross-sectional surface increases in the flow direction of the cooling medium up to a maximum in a first, widening partial section, then decreases again in a second, narrowing partial section behind the maximum, with the cooling medium in the second, narrowing partial section being accelerated with a directional component in the direction of the suction side of the turbine blade. It is provided here that the cooling air duct forms a bulge in the area of the maximum in the direction of the pressure side, with the cooling medium in the first partial section being deflected in the direction of the pressure side, and in the second partial section in the direction of the suction side.

The present invention is based on the idea of first decelerating the cooling medium in the first, widening partial section and then accelerating it in the second, narrowing partial section while shaping the cooling air duct such that the cooling medium is deflected in the direction of the suction side of the turbine disk during the acceleration that it undergoes in the second, narrowing partial section. As a result, the effect of the Coriolis force, which accelerates the cooling medium during rotation of the turbine blade in the direction of the pressure side, is at least partially compensated. The cooling medium can thus flow better inside the cooling air duct, while the heat transfer via all the walls of the cooling air duct is nevertheless evened out. The result is a more homogeneous temperature distribution and improved cooling of the turbine blade.

Due to the more homogeneous temperature distribution, thermally induced stresses in the material of the turbine disk are also reduced.

For acceleration of the cooling medium in the second, narrowing partial section with a directional component in the direction of the suction side of the turbine blade, the cooling air duct is shaped such that it forms a bulge in the area of the maximum in the direction of the pressure side, i.e. solely in the direction of the pressure side, or more distinctly in the direction of the pressure side than in the direction of the suction side. This shape of the first partial section has the effect that the cooling medium is routed in the first partial section in the direction of the pressure side, and hence can be effectively accelerated or deflected in the second partial section in the direction of the suction side.

The invention leads to a bulge of the cooling air duct, created by its widening and narrowing partial sections.

The present invention is described in relation to a cylindrical coordinate system having the coordinates x, r and φ, where x indicates the axial direction, r the radial direction and φ the angle in the circumferential direction. The axial direction is as a rule identical to the machine axis of a gas turbine or a turbofan engine in which the invention is implemented. Starting from the x-axis, the radial direction points radially outwards. Terms like "in front of", "behind", "front" and "rear" relate to the axial direction/flow direction inside the gas turbine or of the cooling air duct described here. The term "in front of" thus means "upstream", and the term "behind" means "downstream". Terms such as "outer" or "inner" refer to the radial direction.

The geometrical course of a cooling air duct is here conveniently described by its center line, which represents the connecting line of all geometrical center points (centroids) of the cross-sectional surfaces of the cooling air duct. A cross-sectional surface of the cooling air duct representative for the flow is defined here to the effect that the center line of the cooling air duct always passes perpendicularly through the plane of the cross-sectional surface. In other words, the normal vector of such a cross-sectional surface therefore corresponds to the tangent vector at the center line in the geometrical center point (centroid) of the respective cross-sectional surface.

The cooling air duct has at the start of the widening partial section a first cross-sectional surface A1, at the end of the narrowing partial section a second cross-sectional surface A2, and at the maximum a third cross-sectional surface A3.

For the ratio of first cross-sectional surface A1 and third cross-sectional surface A3, the following applies in accordance with an embodiment of the invention: $1<A3/A1\leq 5$. The ratio of maximum cross-sectional surface to the cross-sectional surface at the start of the first partial section should therefore be, in accordance with this embodiment of the invention, smaller than or equal to 5. The cross-sectional surface should increase in the first partial area by a factor of 5 at most, to prevent an excessive deceleration of the flow of the cooling air medium.

A further embodiment of the invention provides that for the ratio of first cross-sectional surface A1, second cross-sectional surface A2 and third cross-sectional surface A3 the following applies: $A1<A2<A3$. Mathematically, this can also be expressed by the relationship: $A3/A1>A3/A2$. The (second) cross-sectional surface at the end of the second, tapering partial area is therefore larger than the (first) cross-sectional surface at start of the first, widening partial area. Both of these cross-sections are smaller than the maximum cross-section at the transition from the first partial area to the second partial area. It must be borne in mind that the cooling medium in the second partial section additionally undergoes an acceleration/directional component in the direction of the suction side of the turbine blade.

A further embodiment of the invention provides that the cooling air duct does not exceed a maximum degree of divergence over the first, widening partial section. Similarly to an opening angle definition for diffusers, the increase in the cross-sectional surface of the cooling air duct in the first partial section here conveniently relates to the length of the flow path therein, so that this ratio describes the degree of divergence in the first partial section. In the meaning of the present invention, this ratio is defined here as:

$$\frac{\left(\sqrt[2]{A3-A1}\right)}{s} \leq 6$$

The size s here describes the length of the cooling air duct along its center line in the first partial section, and the sizes A1 and A3 already stated above describe the cross-sectional surfaces of the cooling air duct at the start and at the end respectively of the first partial section.

The ratio thus defined, which states the degree of divergence in the widening partial section, is thus a maximum of 6. In accordance with an embodiment of the invention, the stated ratio is in the range between 1.25 and 6 and in particular in the range between 1.25 and 2:

$$1,25 \leq \frac{\left(\sqrt[2]{A3-A1}\right)}{s} \leq 2.$$

The design of the cooling air duct can be rotationally symmetrical or rotationally asymmetrical relative to its center line.

An embodiment of the invention provides that the cooling air duct has in the area of the first partial section a rotational asymmetry relative to its center line, meaning the widened duct has a preferential direction.

Furthermore, it can be provided that the widening of the cooling air duct is solely or more distinctly in the direction of the pressure side of the blading. In this variant of the invention, therefore, the divergence in the first partial section in the direction of the pressure side of the blade is greater than the divergence in the direction of the suction side. The bulge of the cooling air duct in accordance with the invention is in other words in the direction of the pressure side. This permits the cooling medium in the second partial section to be accelerated more effectively in the direction of the suction side. A divergence in the first partial section, which is greater in the direction of the blade pressure side than in the direction of the suction side is concomitant with the fact that the center line of the cooling air duct in the first partial section has a directional component in the direction of the pressure side of the turbine blade, or is inclined in the direction of the pressure side.

A further embodiment of the invention provides that the cooling air duct in the narrowing partial section has a deflection angle δ which is less than 175° and is for example in the range between 110° and 170°, in particular in the range between 140° and 170°. The deflection angle states here the degree of deflection of the cooling air duct in the second partial section. More precisely, δ is defined as that angle generated between the two vectors $\overrightarrow{A3A1}$ and $\overrightarrow{A3A2}$. Both vectors describe the direct connecting line between the geometrical center points (centroids) of the cross-sectional surfaces A3, A2 and A3, A1 respectively. This definition thus indicates the mean deflection angle of the cooling air duct over both partial sections, in the direction of the suction side.

An embodiment of the invention provides that for acceleration of the cooling medium in the second, narrowing partial section with a directional component in the direction of the suction side of the turbine blade, the cooling air duct is shaped such that the center line of the cooling air duct has in the narrowing partial section a directional component in the direction of the suction side of the turbine blade.

In accordance with an embodiment of the invention, the first, widening partial section is however shaped such that the center line of the cooling air duct in the first partial section has a directional component in the direction of the pressure side of the turbine blade.

A start of a first, widening partial section should exist, in the meaning of the present invention, when the cooling air duct upstream of such a start has a constant cross-sectional surface course, a convergent course, or a divergent course which is so minor that the cross-sectional surface along the center line of the cooling air duct increases only slightly upstream of the start of the first partial section under consideration. An only slight increase, in the meaning of the present invention, applies here when the degree of divergence of the cooling air duct $$\frac{\sqrt[2]{\Delta A}}{s}$$

is less than 1.25, therefore $$1.25 > \frac{\sqrt[2]{\Delta A}}{s}$$

applies. In other words, a slight increase applies if in an arbitrarily small longitudinal section of the length s the cross-sectional surface increases by an amount of $\Delta A < (1.25 \cdot s)^2$.

The cooling air duct under consideration can generally speaking have, at any point in the turbine blade, an embodiment in accordance with the invention for accelerating the cooling medium in the direction of the suction side. In a particularly effective way, an embodiment of this type is provided in a section of the cooling air duct in which the cooling medium moves primarily in the radial direction and before the cooling air duct branches out into a plurality of smaller cooling ducts. Accordingly, an embodiment of the invention provides that the turbine blade has a blade root which is provided and suitable for being arranged inside a blade root mounting of a turbine disk, wherein the first, widening partial section and the second, narrowing partial section are formed in a section of the cooling air duct which is arranged in the blade root.

A further embodiment of the invention provides that the cross-sectional surface of the second, narrowing partial section decreases behind the maximum successively and continuously.

The invention furthermore relates to a turbine rotor blade ring for a gas turbine with a turbine blade in accordance with the present disclosure and to a gas turbine, in particular a turbofan engine having a turbine rotor blade ring of that type.

The invention provides in a second aspect of the invention a method for conveying a cooling medium in a turbine blade of a turbine rotor blade ring, in which the cooling medium is decelerated in a first partial section of the cooling air duct and then accelerated in an adjoining second partial section with a directional component in the direction of the suction side of the turbine blade. The cooling medium is here routed such that in the first partial section it is initially subjected to a directional component in the direction of the pressure side and in the second partial section to a directional component in the direction of the suction side, and is thus diverted in the direction of the suction side. By routing the cooling medium initially in the direction of the pressure side, a diversion in the direction of the suction side in the second partial area is facilitated.

Figure 2:
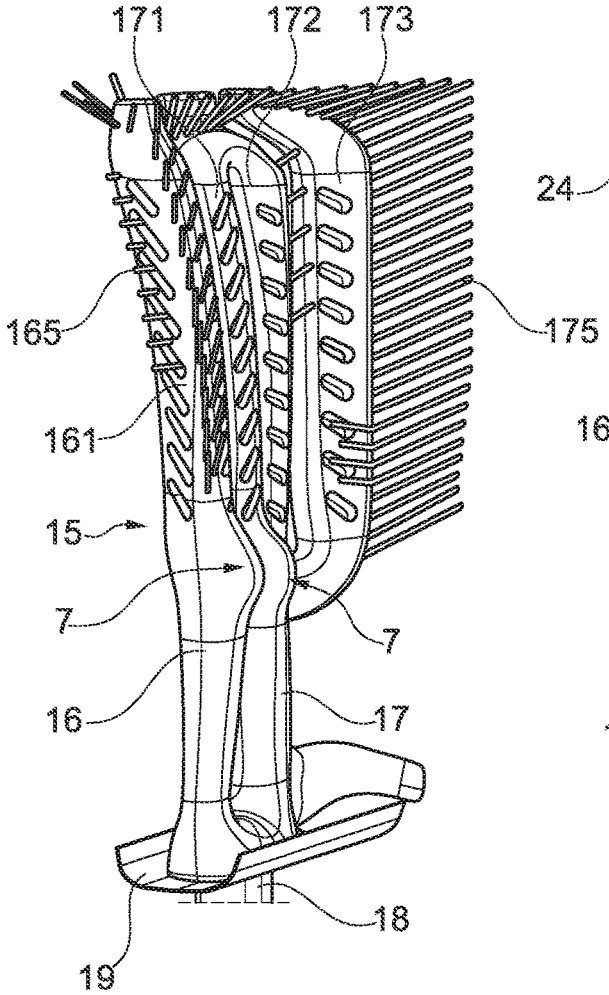
Figure 3:
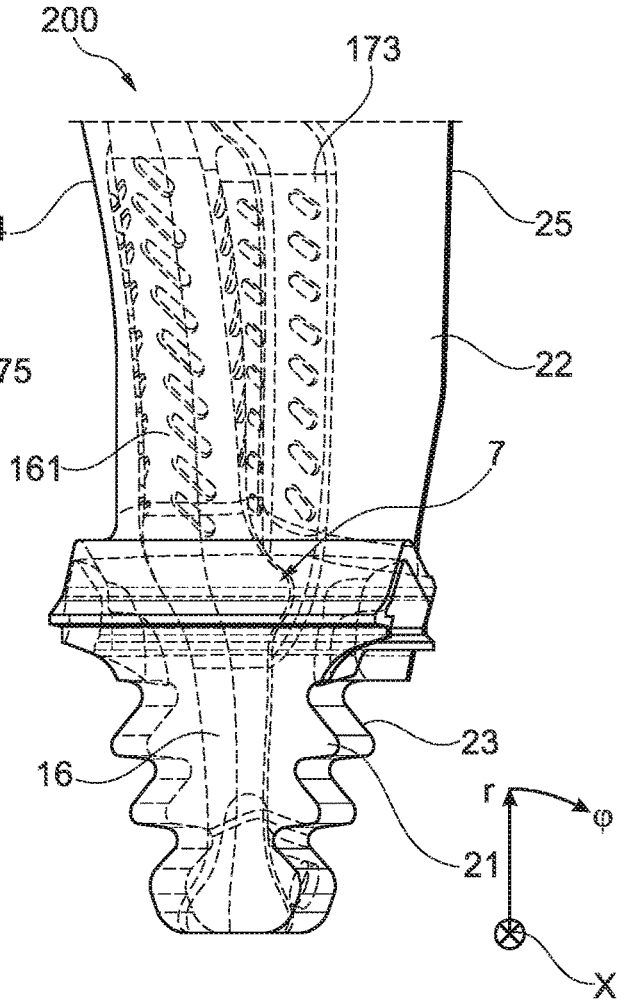
Figure 4:
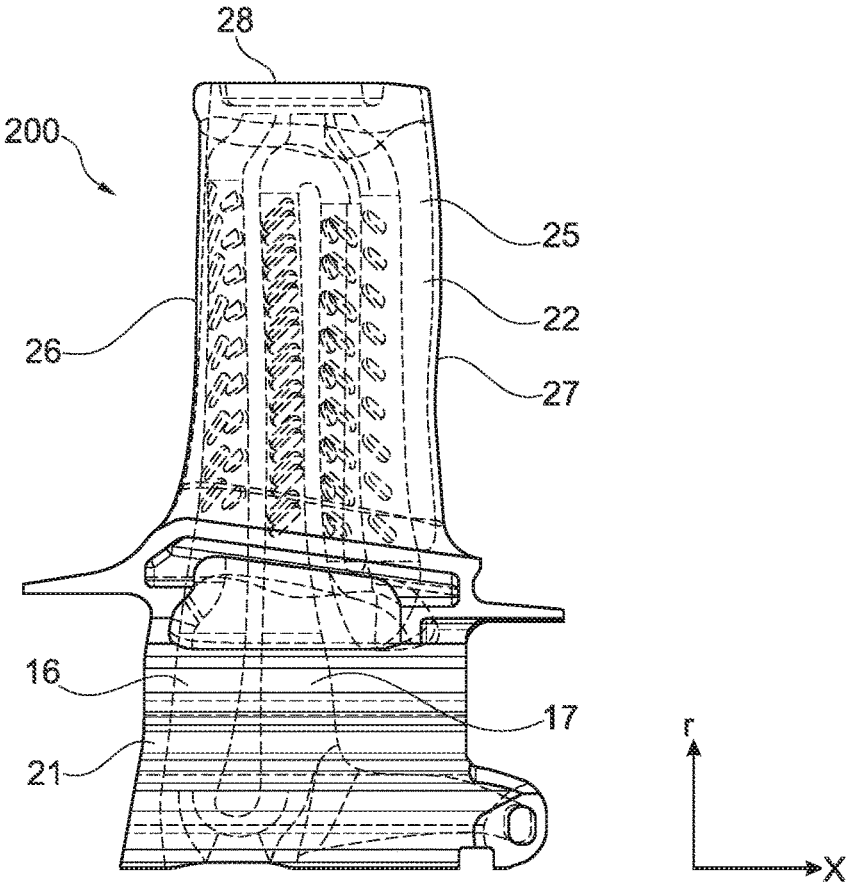
Figure 5:
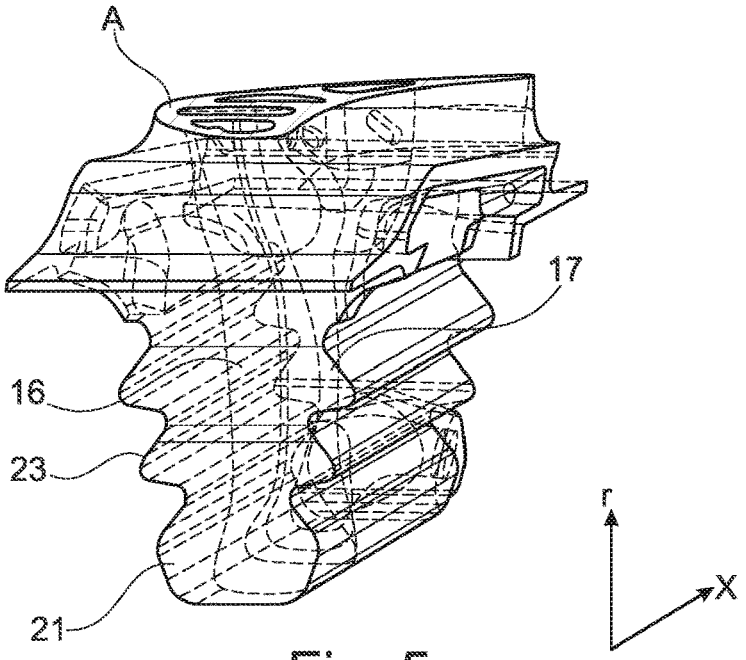
Figure 6:
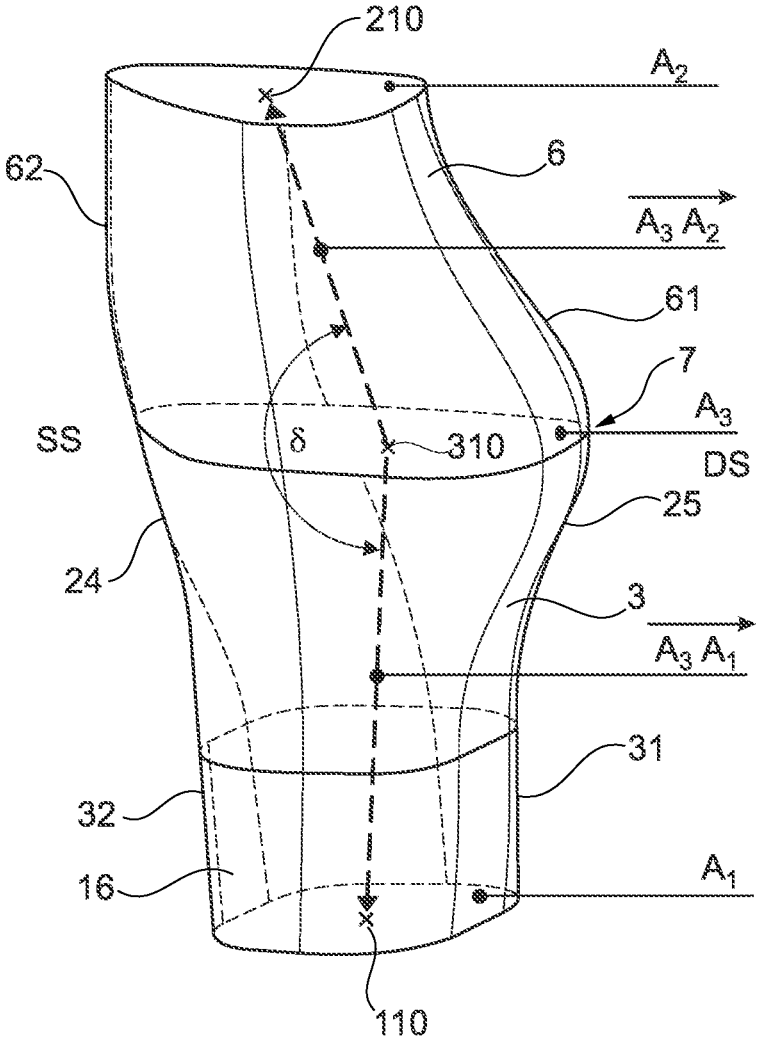
Figure 7:
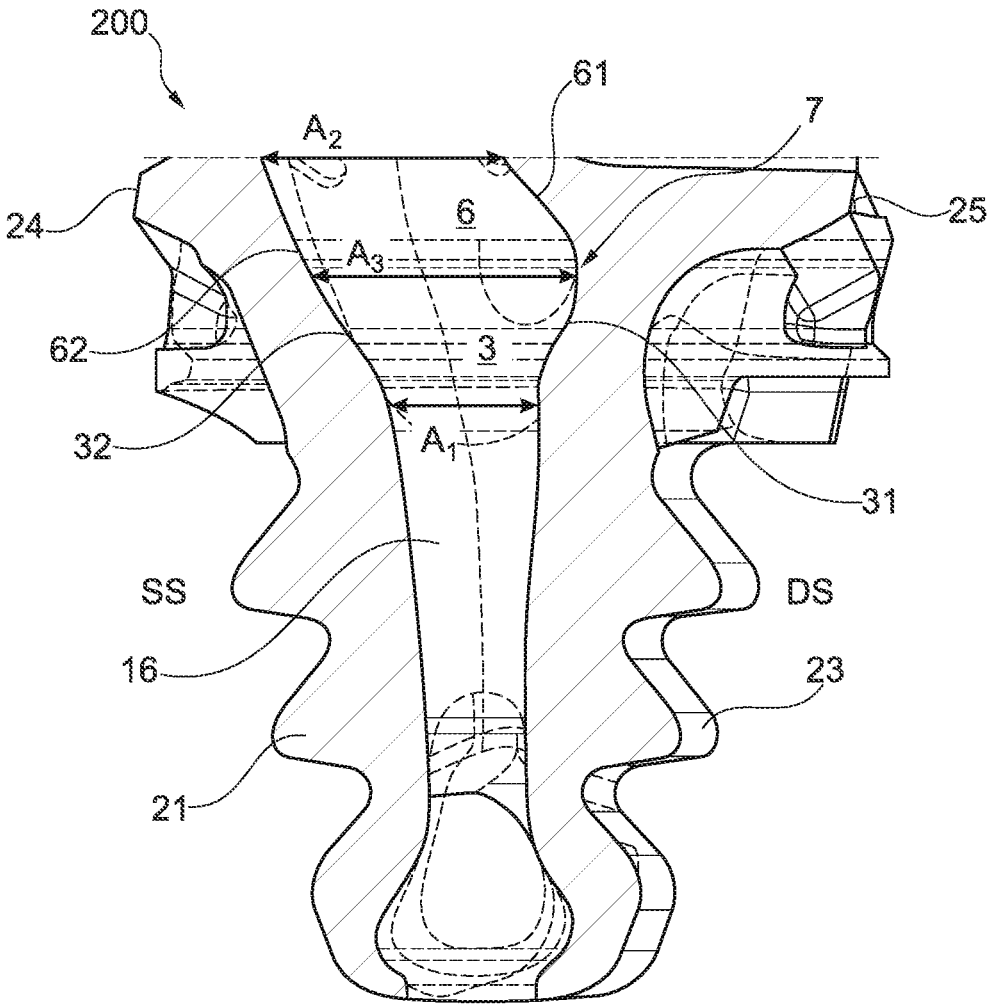
Figure 8:
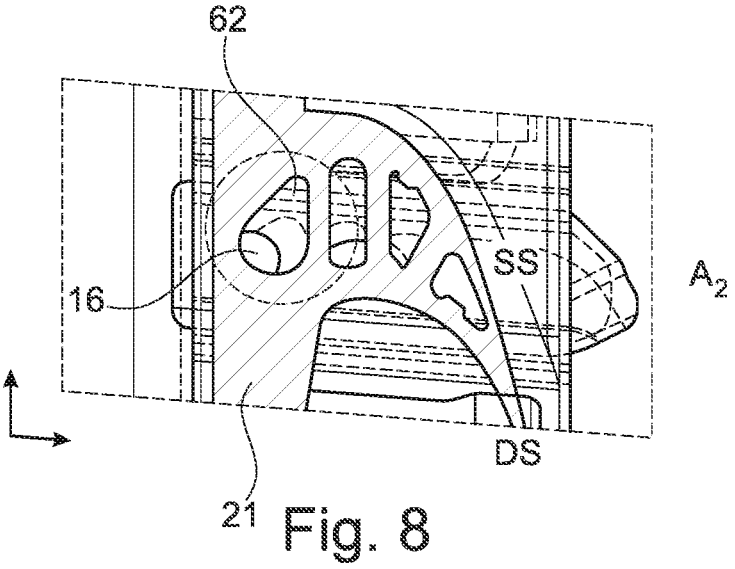
Figure 9:
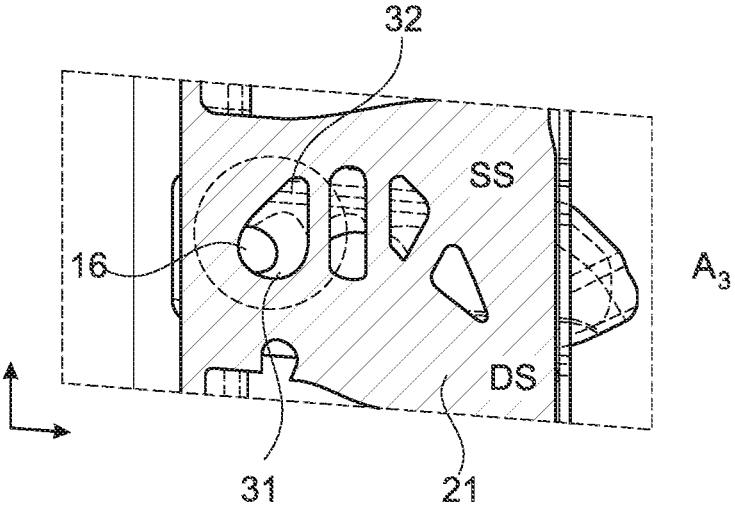
Figure 10:
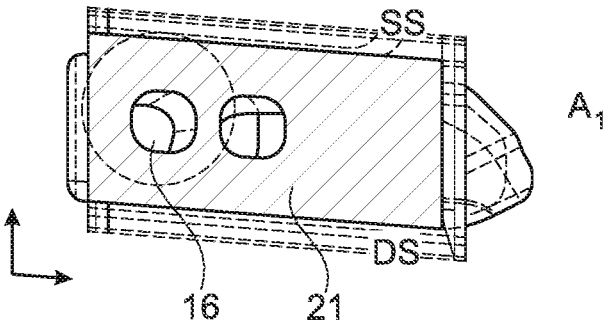

The present invention is more fully described in the following with reference to the Figures of the accompanying drawing showing several exemplary embodiments. In the drawing, FIG. 1 shows a simplified sectional representation of a turbofan engine in schematic form, in which the present invention can be implemented, FIG. 2 shows a negative model of a turbine blade, representing the cooling air ducts provided in the turbine blade, FIG. 3 shows the outer contours of a turbine blade in a view from the front and additionally represents the cooling air ducts as per FIG. 2, FIG. 4 shows the turbine blade of FIG. 3 in a side view onto the pressure side, FIG. 5 shows the blade root of the turbine blade of FIGS. 3 and 4 in a view obliquely from the front, FIG. 6 schematically shows the course of a cooling air duct provided in the blade root, the cross-sectional surface of which increases in the flow direction of the cooling medium in a first partial section, and subsequently decreases in a second partial section, with the cooling medium being accelerated in the direction of the suction side of the turbine blade, FIG. 7 shows a cross-sectional view of a blade root in accordance with FIG. 5 in a plane which is perpendicular to the axial direction, wherein the blade root forms a cooling air duct, the cross-sectional surface of which increases as per FIG. 6 in the flow direction of the cooling medium in a first partial section, and decreases in a second partial section, FIG. 8 shows a cross-sectional view of the blade root of FIG. 7 in a plane perpendicular to the radial direction in a radial height that corresponds to the end of the second partial section, FIG. 9 shows a cross-sectional view of the blade root of FIG. 7 in a plane perpendicular to the radial direction in a radial height that corresponds to the end of the first partial section, and FIG. 10 shows a cross-sectional view of the blade root of FIG. 7 in a plane perpendicular to the radial direction in a radial height that corresponds to the start of the first partial section.

FIG. 1 schematically shows a turbofan engine 100 having a fan stage with a fan 10 as low-pressure compressor, a medium-pressure compressor 20, a high-pressure compressor 30, a combustion chamber 40, a high-pressure turbine 50, a medium-pressure turbine 60 and a low-pressure turbine 70.

The medium-pressure compressor 20 and the high-pressure compressor 30 each have a plurality of compressor stages each comprising a rotor stage and a stator stage. The turbofan engine 100 in FIG. 1 furthermore has three separate shafts, a low-pressure shaft 81 connecting the low-pressure turbine 70 to the fan 10, a medium-pressure shaft 82 connecting the medium-pressure turbine 60 to the medium-pressure compressor 20 and a high-pressure shaft 83 connecting the high-pressure turbine 50 to the high-pressure compressor 30. This should however be understood only as an example. If the turbofan engine has for example no medium-pressure compressor and no medium-pressure turbine, only a low-pressure shaft and a high-pressure shaft are present.

The turbofan engine 100 has an engine nacelle 1 comprising an inlet lip 14 and forming on the inside an engine intake 11 supplying inflowing air to the fan 10. The fan 10 has a plurality of fan blades 101 connected to a fan disk 102. The annulus of the fan disk 102 forms here the radially inner boundary of the flow path through the fan 10. The flow path is delimited by a fan casing 2 radially outwards. A nose cone 103 is arranged upstream of the fan disk 102.

Behind the fan 10, the turbofan engine 100 has a secondary flow duct 4 and a primary flow duct 5. The primary flow duct 5 leads through the core engine (gas turbine) comprising the medium-pressure compressor 20, the high-pressure compressor 30, the combustion chamber 40, the high-pressure turbine 50, the medium-pressure turbine 60 and the low-pressure turbine 70. The medium-pressure compressor 20 and the high-pressure compressor 30 are here surrounded by a circumferential casing 29 that forms on the inside an annular surface which delimits the primary flow duct 5 radially outwards. Radially inwards, the primary flow duct 5 is delimited by corresponding ring surfaces of the rotors and stators of the respective compressor stages and/or by the hub or elements of the corresponding drive shaft connected to said hub.

During operation of the turbofan engine 100 a primary flow passes through the primary flow duct 5, which is also referred to as the main flow duct. The secondary flow duct 4, which is also referred to as the bypass duct, routes air aspirated by the fan 10 past the core engine during operation of the turbofan engine 100.

The components described have a common rotation/machine axis 90. The rotation axis 90 defines an axial direction of the turbofan engine. A radial direction of the turbofan engine is perpendicular to the axial direction.

In the context of the present invention, the design of the turbine blades, in particular the turbine blades of the high-pressure turbine 50, is important. The principles of the present invention are however equally applicable to turbine blades of other turbine stages.

The turbine blades under consideration within the framework of the invention are an integral part of a rotor blade arrangement comprising a turbine disk and a turbine rotor blade ring with turbine rotor blades. The turbine rotor blades are referred to in this description as turbine blades. For fastening the turbine blades equidistantly on the circumference of the turbine disk, said turbine disk has on its circumference a plurality of blade root mountings which each serve to receive a blade root of a rotor blade. It can be provided that the blade roots are designed as so-called "fir-tree roots". The blade root mountings are designed in corresponding manner. The turbine disk has ducts which are used to provide cooling air to cool the turbine blades.

FIG. 2 shows on the basis of an exemplary embodiment a negative model of a turbine blade. The negative model shows the cavities of the turbine blade. They form a system 15 of cooling air ducts used to cool the turbine blade. In the exemplary embodiment shown, the system 15 of cooling air ducts comprises two inlet cooling air ducts 16, 17 both extending in the blade root of the turbine blade. As is further explained in detail, the inlet cooling air ducts 16, 17 form a bulge 7 in which the cross-sectional surface of the inlet cooling air ducts 16, 17 is at a maximum.

In the flow direction behind the bulge 7, the one inlet duct 16 extends as a cooling air duct 161 adjacent to the leading edge of the turbine blade. The other inlet duct 17 forms, in the flow direction behind the bulge 7, a cooling air duct with three serpentine-like sections 171, 172, 173 which extend substantially in the radial direction and are connected to one another by curved areas. Cooling air holes 165, 175 originate from the cooling air ducts and are used for cooling the turbine blade.

Furthermore a duct 18 provided in the associated turbine disk and via which cooling air is supplied can be discerned in FIG. 2. Cooling air escapes between the turbine disk and the turbine blade in a gap 19 extending in the axial direction.

FIG. 2 must be understood only as an example. The precise shape and number of cooling air ducts and the type of cooling are not of importance for the present invention. Film cooling and/or cooling by convection are for example possible. Of importance for the present invention is only the bulge 7 provided in the inlet cooling air ducts 16, 17. It is also pointed out that the cooling air ducts generally have any cross-sectional shape required, and for example can be designed circular, elliptical or rectangular.

FIGS. 3 and 4 show a turbine blade 200 having a system 15 of cooling air ducts corresponding to FIG. 2. This is indicated in FIGS. 3 and 4 by a transparent representation of the turbine blade. The turbine blade 200 is shown in FIG. 3 in a view from the front, i.e. in a view in the axial direction onto the blade leading edge. The turbine blade 200 is shown in FIG. 4 in a side view onto the pressure side. The turbine blade 200 comprises a blade root 21 and an airfoil 22. The blade root 21 is intended to be arranged in a blade root mounting of a turbine blade. It has for example a fir-tree profile 23. The airfoil 22 comprises a suction side 24, a pressure side 25, a leading edge 26, a trailing edge 27 and a blade tip 28. The airfoil 22 projects into the primary flow duct of the turbofan engine.

In FIGS. 3 and 4, x indicates the axial direction and r the radial direction. In a cylindrical coordinate system, the circumferential direction $\varphi$ is perpendicular to x and r. The axial direction x can be identical to the machine axis of a gas turbine in which the invention is implemented, but can also diverge from it (for example if the rotor blades are inserted into the blade root mountings at an angle to the machine axis).

The inlet cooling air ducts 16, 17 and the cooling air ducts 161, 171, 172, 173 extend substantially in the radial direction. The bulge 7 shown in FIG. 2 and discernable in FIG. 3 extends in the direction of the pressure side 25 of the turbine blade 200.

FIG. 5 shows obliquely from the front, in enlarged representation and perspective view, the blade root 21 in which the inlet cooling air ducts 16, 17 are provided. The representation ends at a sectional area A forming a cross-sectional surface of the blade root 21 perpendicular to the radial direction r.

FIGS. 6-10 illustrate the shaping of the one inlet cooling air duct 16 on the one hand schematically (FIG. 6), and on the other hand as an example based on an exemplary embodiment (FIGS. 7-10). The statements apply analogously for the further inlet cooling air duct 17 in FIGS. 3-5, where it is not essential that both inlet cooling air ducts 16, 17 have a shape in accordance with the invention. It is also pointed out that the turbine blade 200 does not necessarily have to have several inlet cooling air ducts 16, 17. In alternative embodiments of the invention, only one inlet cooling air duct is provided, which is designed as described in the following.

FIG. 6 is a three-dimensional illustration of an inlet cooling air duct 16 (in the following referred to as cooling air duct 16). The cooling air duct 16 comprises a first, widening partial section 3, in which the cross-sectional surface of the cooling air duct 16 increases in the flow direction of the cooling medium, starting from a cross-sectional surface A1 at the start of the widening partial section 3, up to a maximum A3. The first, widening partial section 3 is adjoined by a second, narrowing partial section 6, in which the cross-sectional surface is reduced from the maximum cross-sectional surface A3 to a cross-sectional surface A2 at the end of the narrowing partial section 6. In the first partial section 3, the wall of this partial section is formed towards the pressure side 25 by a wall contour 31 and towards the suction side 24 by a wall contour 32. In the second partial section 6, the wall of this partial section is formed towards the pressure side 25 by a wall contour 61 and towards the suction side 24 by a wall contour 62.

The changing cross-sections of the cooling air duct 16 lead to a deceleration of the flow velocity of the cooling medium in the widening partial section 3 and to an acceleration of the flow velocity of the cooling medium in the tapering partial section 6.

The cooling air duct 16 is, in the sections 3, 6 under consideration, furthermore shaped such that the cooling medium in the second, narrowing partial section 6 is accelerated with a directional component in the direction of the suction side of the turbine blade. Due to this acceleration of the cooling medium, an acceleration of the cooling medium due to the Coriolis force is countered. In this way, a homogenization of the heat transfer is achieved in a cross-sectional plane under consideration at all wall areas of the cooling air duct.

For an acceleration of the cooling medium in the direction of the suction side, the cooling air duct 16 has towards the pressure side the bulge 7, with the cooling medium being deflected in the first partial area 3 in the direction of the pressure side and in the second partial area 6 in the direction of the suction side.

The precise shaping is as follows. The cross-sectional surface A1 is the cross-sectional surface at the start of the first partial area 3. Starting from there, the cross-sectional surface of the cooling air duct increases rotationally asymmetrically relative to its center line in the direction of the pressure side. The geometrical course of the cooling air duct 16 is described here by its center line, which represents the connecting line of all geometrical center points (i.e. centroids) of the cross-sectional surfaces of the cooling air duct. A cross-sectional surface of the cooling air duct 16 representative for the cooling airflow is defined here such that the center line of the cooling air duct 16 always passes perpendicularly through the plane of the cross-sectional surface. In other words, the normal vector of such a cross-sectional surface therefore corresponds to the tangent vector at the center line in the geometrical center point (centroid) of the respective cross-sectional surface.

It must be borne in mind here that the cross-sectional widening can be rotationally symmetrical or alternatively rotationally asymmetrical relative to the center line of the cooling air duct. In the present example, the rotationally asymmetrical duct widening, which is concomitant with a routing of the cooling air duct 16 initially in the direction of the pressure side, leads to an increase of the structurally achievable deflection angle $\delta$ in the second partial area 6.

The degree of divergence of the widening cooling air duct 16 should not exceed a maximum degree of divergence. Similarly to an opening angle definition for diffusers, the maximum increase in the cross-sectional surface of the cooling air duct 16 in the first partial section 3 here conveniently relates to the length of the flow path therein, so that this ratio describes the degree of divergence in the first partial section 3. In the meaning of the present invention, this maximum ratio is defined as:

$$\frac{(\sqrt[2]{A3-A1})}{s} \leq 6$$

The size s here describes the length of the cooling air duct along its center line in the first partial section 3, and the sizes A1 and A3 already stated above describe the cross-sectional surfaces of the cooling air duct at the start and at the end respectively of the first partial section 3. The stated ratio is in accordance with an embodiment of the invention between 1.25 and 2.

The cross-sectional surface ratio A3/A1 is, in accordance with an embodiment of the invention, in the range between 1 and 5, for example between 2 and 4.

The cross-sectional surface A3 at the transition between the first partial area 3 and the second partial area 6 represents the maximum cross-sectional surface. Starting from this maximum, the cooling air duct 16 tapers in the second partial area 6.

The convergence of the cooling air duct in the second partial area 6 is defined by the ratio A3/A2. It is provided here that this ratio is smaller than the ratio A3/A1, in other words A1 is less than A2 and A2 is less than A3:

$$A1<A2<A3.$$

The form of convergence in the second partial area 6 is, among others, determined by the convergence or deflection angle δ. This angle δ is defined as that angle generated between the two vectors $\overrightarrow{A3A1}$ and $\overrightarrow{A3A2}$. Both vectors describe the direct connecting line between the geometrical center points (centroids) 310, 210 and 110 of the cross-sectional surfaces A3, A2 and A3, A1 respectively. The definition thus states the mean deflection angle of the cooling air duct over both partial sections 3, 6, in the direction of the suction side.

The maximum deflection angle δ is 175°. It is for example in the range between 110° and 170°, in particular in the range between 140° and 170°.

It is pointed out that the cross-sectional surface stated here is defined by a normal vector that corresponds to the tangent vector at the center line in the geometrical center point (centroid) of the respective cross-sectional surface.

It is furthermore pointed out that the first, widening partial section 3 is shaped such that the vector or the center line of the cooling air duct in the first partial section 3, said center line corresponding at least approximately to the vector, has—due to the bulge 7 that extends in the direction of the pressure side 25—a directional component towards the cross-sectional surface A3 in the direction of the pressure side 25, and does not extend exactly radially.

FIG. 7 shows as an example an exemplary embodiment of a cooling air duct 16 which is shaped according to FIG. 6 and is provided in the blade root 21 of a turbine blade 200. FIGS. 8, 9 and 10 show cross-sections perpendicular to the radial direction of the blade root 21 at the levels of cross-section A2 (FIG. 8), cross-section A3 (FIG. 9) and cross-section A1 (FIG. 10). FIG. 7 shows the first diverging partial section 3 with the wall contours 31, 32, the second converging wall section 6 with the wall contours 61, 62, and the three cross-sectional surfaces A1, A3 and A2. The bulge 7 extends in the direction of the pressure side 25.

In accordance with FIG. 10, the cooling air duct 16 in the area of the cross-sectional surface A1 is designed approximately circular (rotationally symmetrical relative to the center line). Wall areas extending in the direction of the pressure side or suction side are not provided. In accordance with FIG. 9, the cooling air duct 16 in the area of the cross-sectional surface A3 is designed no longer circular (but rotationally asymmetrical relative to the center line). Instead, the wall areas 31, 32 designed as already described in accordance with FIG. 7 lead to a larger extent in the circumferential direction (between pressure side and suction side) than in the axial direction. The same applies in accordance with FIG. 8 for the cooling air duct 16 in the area of the cross-sectional surface A2, where in the view as shown from above the oblique wall area 62 can be discerned.

The present invention is not restricted in its design to the exemplary embodiments described above. For example, it can be alternatively provided that a bulge of a cooling air duct in accordance with the invention is provided not in the blade root, but at another point in the cooling air duct, or that a cooling air duct has several such bulges, for example a bulge in the blade root and a further bulge in the further course of the cooling air duct.

It is furthermore pointed out that the features of the individually described exemplary embodiments of the invention can be combined with one another in various combinations. To the extent that ranges are defined, they comprise all the values within these ranges and all partial areas that lie within a range.

The invention claimed is:

1. A turbine blade of a turbine rotor blade ring, comprising:

a suction side, a pressure side, and a cooling air duct through which a cooling medium is conveyable for cooling the turbine blade, the cooling air duct including a cross-sectional surface, wherein the cooling air duct has in at least one section, a course such that:

the cross-sectional surface increases in a flow direction of the cooling medium up to a maximum in a first, widening partial section, the cross-sectional surface decreases in a second, narrowing partial section behind the maximum, and the second, narrowing partial section causes the cooling medium to accelerate with a directional component in a direction of the suction side of the turbine blade, wherein the cooling air duct forms a bulge in an area of the maximum in a direction of the pressure side, wherein the cooling medium is deflected in the first, widening partial section in the direction of the pressure side and in the second, narrowing partial section in the direction of the suction side, wherein a center line of the cooling air duct has in the first, widening partial section has a directional component in the direction of the pressure side, wherein for the acceleration of the cooling medium in the second, narrowing partial section in the direction of the suction side, the center line of the cooling air duct has in the second, narrowing partial section a directional component in the direction of the suction side, wherein a divergence in the first, widening partial section in the direction of the pressure side of the blade is greater than a divergence in the direction of the suction side of the blade.

2. The turbine blade in accordance with claim 1, wherein the cooling air duct has at the start of the first, widening partial section a first cross-sectional surface A1, at the end of the second, narrowing partial section a second cross-sectional surface A2, and at the maximum of the cross-sectional surface a third cross-sectional surface A3.

3. The turbine blade in accordance with claim 2, wherein for the ratio of first cross-sectional surface A1 and third cross-sectional surface A3, the following applies:

$$1<A3/A1\leq 5.$$

4. The turbine blade in accordance with claim 2, wherein for the ratio of first cross-sectional surface A1, second cross-sectional surface A2 and third cross-sectional surface A3, the following applies:

$$A1<A2<A3.$$

5. The turbine blade in accordance with claim 2, wherein the cooling air duct in the second, narrowing partial section has a deflection angle (δ) smaller than 175°, with δ being defined as an angle generated between two vectors $\overrightarrow{A3A1}$ and $\overrightarrow{A3A2}$, wherein both vectors describe a direct connecting line between geometrical center points of the cross-sectional surfaces A3, A2 and A3, A1 respectively.

6. The turbine blade in accordance with claim 5, wherein the deflection angle (δ) is in a range between 110° and 170°.

7. The turbine blade in accordance with claim 5, wherein the deflection angle (δ) is in a range between 140° and 170°.

8. The turbine blade in accordance with claim 1, wherein the cooling air duct does not exceed a maximum degree of divergence in the first, widening partial section, wherein the degree of divergence is defined by a square root of an increase in cross-sectional surface (A3–A1) with reference to a length (s) of the cooling air duct along the center line, and the degree of divergence is less than/equal to 6, therefore the following applies:

$$\frac{\left(\sqrt[2]{A3-A1}\right)}{s}\leq 6.$$

9. The turbine blade in accordance with claim 8, wherein the degree of divergence in the first, widening partial section of the cooling air duct is in a range between 1.25 and 6, therefore the following applies:

$$1.25<\frac{\left(\sqrt[2]{A3-A1}\right)}{s}\leq 6.$$

10. The turbine blade in accordance with claim 8, wherein the degree of divergence in the first, widening partial section of the cooling air duct is in a range between 1.25 and 2, therefore the following applies:

$$1.25<\frac{\left(\sqrt[2]{A3-A1}\right)}{s}\leq 2.$$

11. The turbine blade in accordance with claim 1, wherein a divergence in the first, widening partial section in the direction of the pressure side is greater than the divergence in the direction of the suction side of the blade.

12. The turbine blade in accordance with claim 1, wherein the turbine blade has a blade root, wherein the first, widening partial section and the second, narrowing partial section are formed in a section of the cooling air duct which is arranged in the blade root.

13. The turbine blade in accordance with claim 1, wherein the cross-sectional surface of the second, narrowing partial section decreases behind the maximum successively and continuously.

14. A turbine blade of a turbine rotor blade ring, comprising:

a suction side, a pressure side, and a cooling air duct through which a cooling medium is conveyable for cooling the turbine blade, the cooling air duct including a cross-sectional surface, wherein the cooling air duct has in at least one section, a course such that:

the cross-sectional surface increases in a flow direction of the cooling medium up to a maximum in a first, widening partial section, the cross-sectional surface decreases in a second, narrowing partial section behind the maximum, and the second, narrowing partial section causes the cooling medium to accelerate with a directional component in a direction of the suction side of the turbine blade, wherein the cooling air duct forms a bulge in an area of the maximum in a direction of the pressure side, wherein the cooling medium is deflected in the first, widening partial section in the direction of the pressure side and in the second, narrowing partial section in the direction of the suction side, wherein the cooling air duct does not exceed a maximum degree of divergence in the first, widening partial section, wherein the degree of divergence is defined by a square root of an increase in cross-sectional surface (A3–A1) with reference to a length (s) of the cooling air duct along the center line, and the degree of divergence is less than/equal to 6, therefore the following applies:

$$\frac{\left(\sqrt[2]{A3-A1}\right)}{s}\leq 6.$$

15. The turbine blade in accordance with claim 14, wherein the cross-sectional widening of the cooling air duct is rotationally symmetrical relative to the center line.

16. The turbine blade in accordance with claim 14, wherein the cross-sectional widening of the cooling air duct is rotationally asymmetrical relative to the center line.

17. The turbine blade in accordance with claim 14, wherein the degree of divergence in the first, widening partial section of the cooling air duct is in a range between 1.25 and 6, therefore the following applies:

$$1.25<\frac{\left(\sqrt[2]{A3-A1}\right)}{s}\leq 6.$$

18. The turbine blade in accordance with claim 14, wherein the degree of divergence in the first, widening partial section of the cooling air duct is in a range between 1.25 and 2, therefore the following applies:

$$1.25<\frac{\left(\sqrt[2]{A3-A1}\right)}{s}\leq 2.$$

19. A method for conveying a cooling medium in a turbine blade of a turbine rotor blade ring, comprising:

providing that the turbine blade includes a suction side, a pressure side and a cooling air duct, conveying a cooling medium through the cooling air duct for cooling the turbine blade, decelerating the cooling medium in a first partial section of the cooling air duct and then accelerating the cooling medium in an adjoining second partial section, routing the cooling medium such that in the first partial section, the cooling medium is initially subjected to a directional component in a direction of the pressure side and in the second partial section to a directional component in a direction of the suction side, providing that the first partial section includes a cross-sectional widening of the cooling air duct that is rotationally asymmetrical relative to a center line of the cooling air duct.

* * * * *